US005716287A

United States Patent [19]

Levocz et al.

[11] Patent Number: 5,716,287

[45] Date of Patent: Feb. 10, 1998

[54] ADJUSTABLE GOLF PUTTER

[75] Inventors: Reynold J. Levocz, West Chester; Joseph W. Szewc, Philadelphia, both of Pa.

[73] Assignee: J. C. Livingston & Associates, Inc., Media, Pa.

[21] Appl. No.: 784,907

[22] Filed: Jan. 16, 1997

[51] Int. Cl.[6] ..... A63B 53/02; A63B 53/06

[52] U.S. Cl. ..... 473/248; 473/328

[58] Field of Search ..... 473/248, 246, 473/328

[56] References Cited

U.S. PATENT DOCUMENTS

| | | | |
|---|---|---|---|
| D. 240,245 | 6/1976 | Aragona | D34/5 GH |
| 1,840,924 | 3/1932 | Tucker . | |
| 3,319,962 | 5/1967 | Summers | 273/164 |
| 3,989,257 | 11/1976 | Barr | 273/175 |
| 4,141,556 | 2/1979 | Paulin | 273/164 |
| 4,702,477 | 10/1987 | Solomon | 273/80 |
| 5,160,141 | 11/1992 | Crews | 273/164.1 |
| 5,267,733 | 12/1993 | Szokola | 273/167 G |
| 5,294,122 | 3/1994 | Longo | 273/162 E |
| 5,308,063 | 5/1994 | Vendur | 473/248 |
| 5,382,019 | 1/1995 | Sneed | 273/80 C |
| 5,531,445 | 7/1996 | Levocz et al. | 473/341 |
| 5,542,665 | 8/1996 | Levocz et al. | 473/313 |
| 5,580,051 | 12/1996 | Fisher | 473/248 |

FOREIGN PATENT DOCUMENTS 377463 7/1932 United Kingdom .

*Primary Examiner*—George J. Marlo
*Attorney, Agent, or Firm*—Ratner & Prestia

[57] ABSTRACT

An adjustable golf putter having a shaft, a putter head and an angle adjusting adapter for adjusting the angle between the shaft and the putter head. The adapter has two sets of a plurality of holes arrayed along two arcs of circle opposite each other into which a pin extending from the lower part of the handle shaft and a pin extending from the rear surface of the putter are inserted respectively to define a preselected shaft to putter head angle such angle being defined by the combination of two of the plurality of holes. The combination of two sets of holes in two arcs of circle allows adjustment of the shaft to putter head angle in increments which are smaller than the distance between two adjacent holes.

15 Claims, 5 Drawing Sheets

ADJUSTABLE GOLF PUTTER

BACKGROUND OF THE INVENTION

1. Field of the Invention

This invention relates generally to golf clubs and more particularly to an adjustable golf putter.

2. Description of Related Art

Most golfers today understand that the "short game" can make or break a round of golf. As they say, "you drive for show and you putt for dough." Accordingly, due to this increased awareness, as well as improved technology in the industry, the golf putter has undergone substantial changes in order to assist the golfer in improving his or her putting stroke.

A major problem associated with putting includes hitting the ball in an unintended direction due to various factors. Some of these factors include an inadvertent turning of the wrists during the stroke, catching the club on the grass, not hitting the ball in the sweet spot, and wobbling or deflection of the club head.

A particular problem regarding the putting stroke relates to the angle of the shaft relative to the putter head. The shaft must desirably be attached to the putter at a predetermined angle, which may be different for each golfer, depending to a large extent on the golfer's height, stance and stroke. Thus as a golfer is learning his or her game, it often becomes necessary to change the angle at which the shaft is attached to the putter head in order to better match the putter to the golfer. However, due to stringent golf competition rules, most putter club shafts are typically permanently mounted onto the putter head and, in order to change the angle of attachment, one must buy a whole new putter with a different shaft angle.

U.S. Pat. No. 5,542,665, issued to Levocz et al., discloses an adjustable putter. The putter comprises a reversible key placed between the putter head and the shaft. The key has two main purposes. First, the key is formed at an angle such that when it is placed between the shaft and putter head, the shaft is set at an angle corresponding to the angle of the key. Second, the key is reversible such that the key can be flipped to accommodate either a right-handed or left-handed stance. Although this device allows one to preset the angle of the shaft attachment to the putter head, there is a problem in that if one desires to change the angle, a different key, defining a different angle, must be inserted to make such a change.

As such, there is a need for a putter which alleviates some of the aforementioned problems and provides a shaft to putter head attachment whereby the angle of the shaft to the putter head can be adjusted without the need to insert a different angle setting piece for each desired angle, and which includes the ability to adjust the shaft position from a right-handed stance to a left-handed stance, while conforming with United States Golf Association Rules.

These and other objects of the present invention will become clear from the following description.

SUMMARY OF THE INVENTION

The present invention is a golf putter comprising:

an elongated shaft having a first attachment surface;

a putter head having a second attachment surface;

an adapter having a first plurality of angle defining holes along a first arc of circle and a second plurality of angle setting holes along a second arc of circle;

a first locator pin on one of said first and second attachment surfaces for engaging one of said first plurality of angle defining holes and a second locator pin on the other one of said attachment surfaces for engaging said second plurality of angle setting holes; and a fastener attaching said elongated shaft and said adapter to the putter head.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 1:
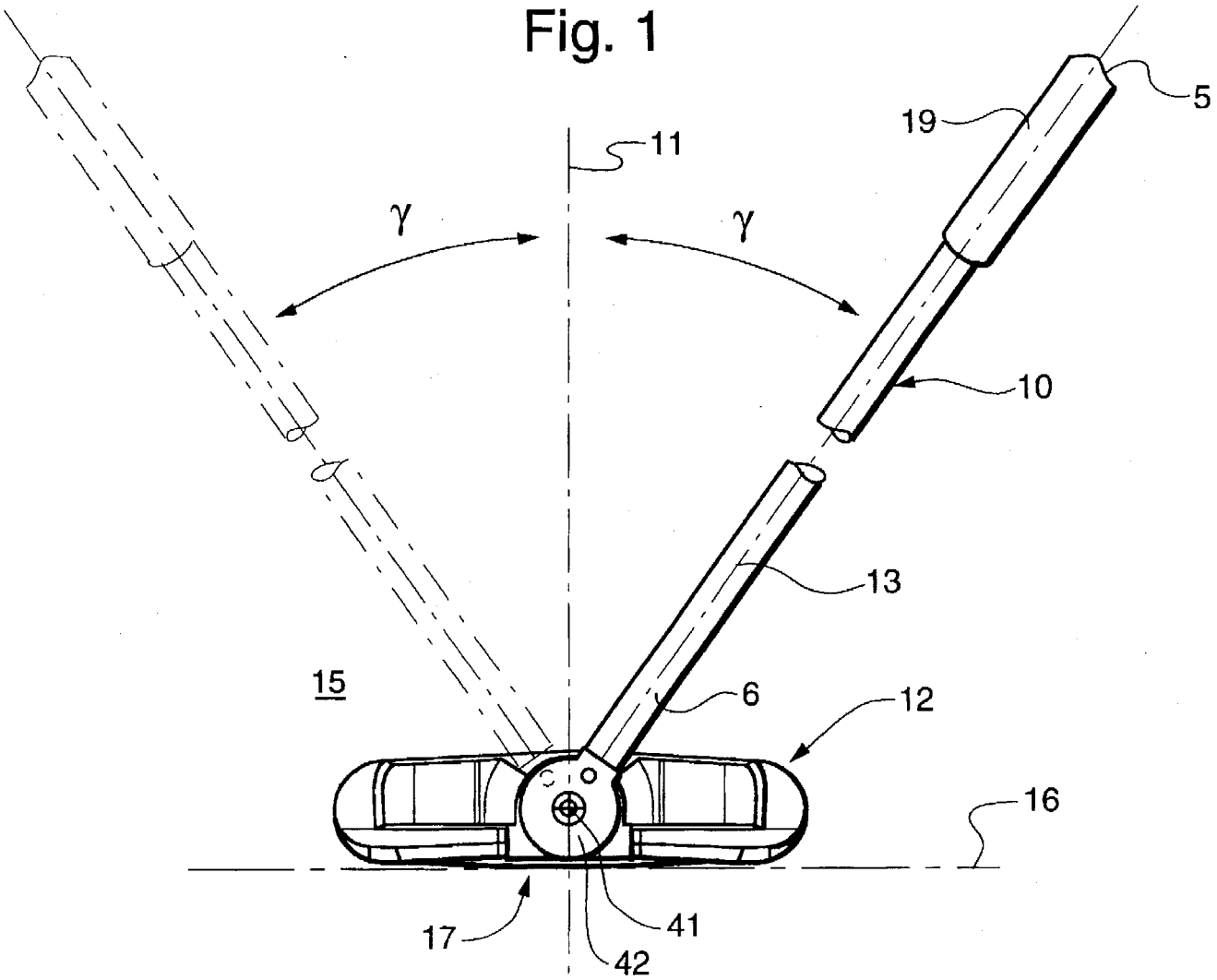
FIG. 1 is a schematic elevation of a putter constructed in accordance with the present invention

Throughout the following detailed description, similar reference characters refer to similar elements in all figures of the drawings.

Since the putter is a free standing device which can be inclined or rotated at will, the relative orientations of the different putter plane surfaces or axes referred to in this description are to be determined as follows:

The putter is a two part device comprising an elongated handle and a putter head. For reference purposes we consider the putter head as being inscribed within an imaginary rectangular parallelepiped which has a front planar reference surface and a bottom, also planar reference surface, the bottom reference surface being horizontal and the front reference surface being vertical. The front and bottom reference surfaces define the vertical and horizontal planes used for orientation throughout the following description.

Referring now to FIG. 1 of the drawings, there is shown a golf putter constructed in accordance with the teachings of the present invention. The golf putter includes a conventional, elongated handle shaft 10 and a putter head 12. The shaft 10 is formed of any common golf club shaft material, including, but not limited to steel, graphite, wood, or a composite. The putter head 12 may be composed of any common club head material, including but not limited to brass, steel, aluminum, or any suitable metal alloy.

The shaft 10 includes a distal end 5, a proximate end 6, and a shaft axis 13 extending the shaft length. The axis 13 preferably lies in a shaft plane which is parallel to the front reference surface 15. Axis 13 forms an angle $\gamma$, measured in a plane parallel to the front reference plane containing the shaft axis, with a vertical line 11. Line 11 is defined by the intersection of two planes, one being the plane containing the shaft axis 13 and a second, vertical plane, mutually perpendicular to the front reference surface 15 and the bottom reference surface 16. In the preferred embodiment this second vertical plane also contains a strike axis 14 whose exact location will be described later in this specification.

Covering a portion of the distal end 5 is a conventional golf grip 19. The grip 19 can be formed of any conventional grip material including leather or rubber. The proximate end 6 is attached to the putter head 12, preferably so that the shaft axis 13 intersects the strike axis 14.

Figure 2:
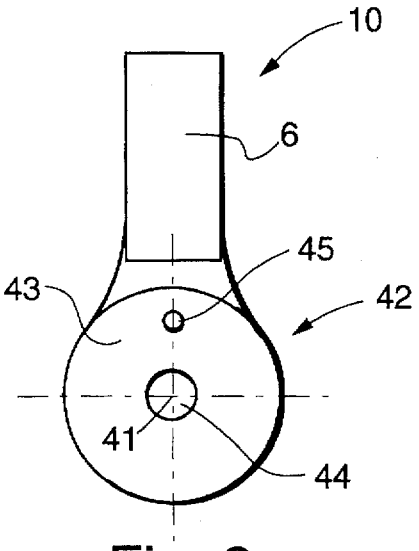
FIG. 2 is a schematic close up view of one end of the putter shaft showing an attachment hosel in accordance with the present invention.
Figure 3:
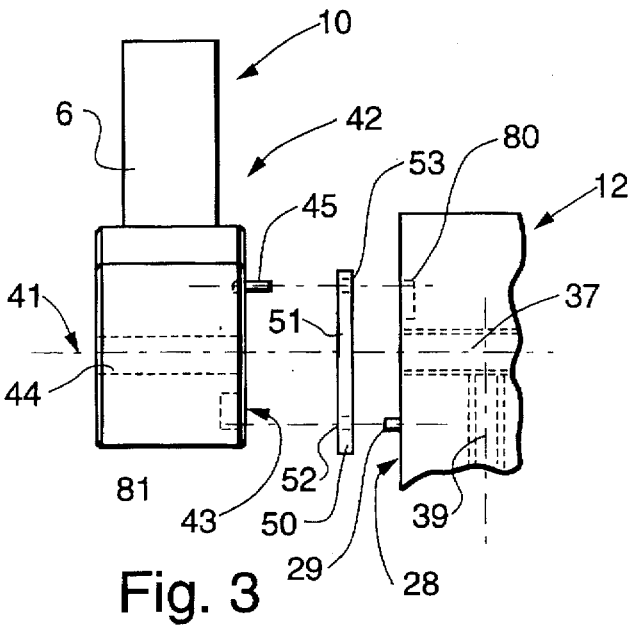
FIG. 3 is an elevation view of the putter showing the relative positioning of the shaft hosel, the adapter and the rear surface of the putter head.

The proximate end 6 of the shaft terminates to a connecting hosel 42 as shown in greater detail in FIGS. 2 and 3. Connecting hosel 42 is preferably cylindrical having an axis 41 extending perpendicular to the shaft axis 13. Rounded edges provide a smooth transition from the shaft to the cylinder. Connecting hosel 42 is provided with a first attachment surface 43 perpendicular to axis 41. Preferably surface 43 is planar.

Located on surface 43 and extending therefrom preferably parallel to the axis 41 is a locator pin 45. An attachment hole 44 extends through the connecting hosel coaxial with the connecting hosel axis 41. Typically the locator pin 45 is placed directly above or directly below the attachment hole 44.

Figure 4:
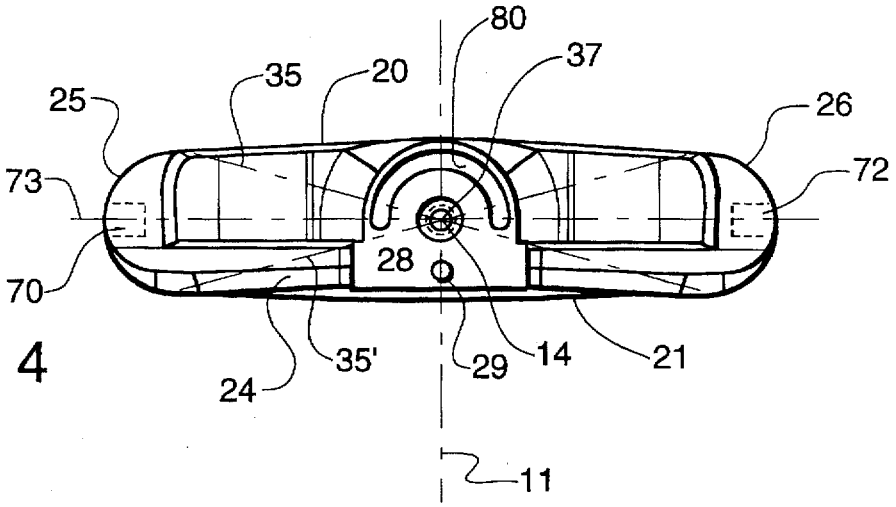
FIG. 4 is a rear elevation view of a putter head in accordance with this invention.
Figure 5:
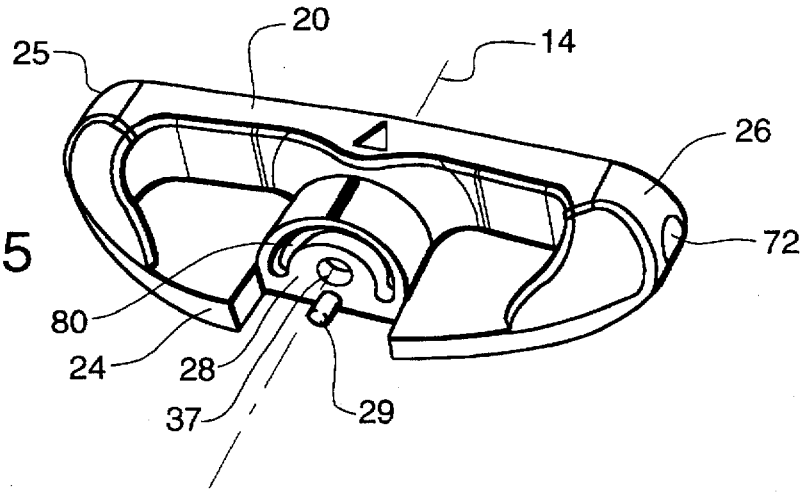
FIG. 5 is a schematic perspective view of a putter head in accordance with this invention.
Figure 6:
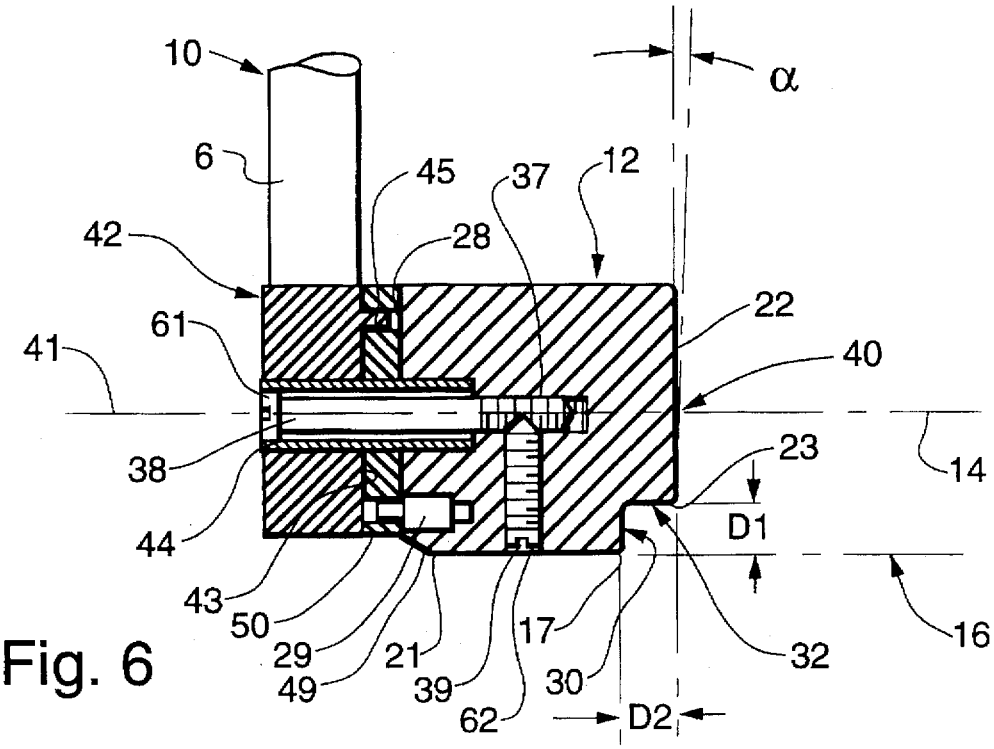
FIG. 6 is an elevation cross section of an assembled putter in accordance with this invention.

The putter head is shown in detail in FIGS. 4, 5, and 6. It includes a top 20 located directly above and opposite a sole 21. In addition, the putter head 12 includes a rear surface 24 and a generally planar strike face 22 located opposite the rear surface 28. The strike face 22, is preferably slightly beveled forming an angle $\alpha$ with respect to the front reference plane 15. The angle $\alpha$ typically varies between 1 and 3 degrees but may vary significantly from these values, depending on the golfer's wants and needs. The putter head 12 finally includes a heel 25 and a corresponding toe 26 located opposite the heel 25.

In the preferred embodiment there is also a provision for the addition of weights to the toe 25 and heel 26 regions of the putter head 12. This is done by providing two weight cavities 70 and 72 aligned along a horizontal axis 73 running through and perpendicular to strike axis 14. Caps (not shown) may be provided to cover cavities 70 and 72 once the proper weights have been inserted to weigh and balance the head 12 for a particular user. The weights are typically, but not exclusively, properly sized lead inserts.

As better shown in FIG. 6, the putter head 12 includes an angular cutout located at the intersection of the strike face 22 and the sole 21. The cutout has a first, vertical planar side 30 and a second, horizontal planar side 32. The horizontal side 32 is located a distance D1 from the lowermost point 17 of the sole 21 of the putter head 12. The vertical side 30 is located a distance D2 from the intersection of the horizontal side 32 and the strike face 22. Distances D1 and D2 can range from ⅛ to ⅝ inches and are preferably equidistant. In the preferred embodiment D1=D2=3/16 inches.

A strike axis 14 extends through the putter head center of gravity. The point 40 where the strike axis 14 intersects the striking face 22 is referred to as the sweet spot. The sweet spot 40 is the pinnacle position of the face 22 on which to strike the golf ball. Because of its location, the sweet spot 40 provides the least "wobble" or deflection in the club head 12 at the moment the head 12 strikes the ball.

Preferably the balancing weights discussed above, are placed symmetrically distant from the strike axis 14, in equal amounts, in the two cavities maintaining the original center of gravity; however, the weights and/or position could be slightly unbalanced to achieve a desired "feel" to the putter and to adjust for any physical impairments of the user.

Determining the exact center of gravity of the putter head 12 is not always simple. On the other hand, it is not necessary to locate the sweet spot 40 and strike axis 14 with absolute accuracy. For practical purposes, the location of the sweet spot is found with sufficient accuracy by drawing two imaginary diagonals 35 and 35', best shown in FIG. 4, extending between opposing corners of a parallelogram defined by the outermost edge 23 and the top 20 of the head 12. The strike axis 14 is drawn through the intersection of the diagonals perpendicular to the front reference surface.

On the putter rear surface, there is a second attachment surface 28 which is best seen in FIGS. 3, 4 and 5. Preferably, attachment surface 28 is located directly behind the sweet spot 40 of the putter head 12. Attachment surface 28 comprises a flat surface having a locator pin 29 extending therefrom, in a direction perpendicular from the plane of attachment surface 28. Also formed on attachment surface 28 is a first threaded socket 37. Threaded socket 37 extends along strike axis 14 into the putter head toward the striking face. Threaded socket 37 is preferably located directly behind sweet spot 40 of putter head 12, coaxial with strike axis 14, and is adapted to contain a fastener 38. Preferably, locator pin 29 is provided on attachment surface 28 directly below or directly above threaded socket 37 along vertical line 11.

In the preferred embodiment, the assembled putter club includes an adapter 50. The adapter 50, is illustrated in FIGS. 7(*a*) and 7(*b*) and FIGS. 8(*a*)–8(*f*); it comprises a generally flat piece, preferably circular in shape, having a center hole 51.

Although it is preferred that adapter 50 be circular in shape, it can be any shape desired, so long as it can be inserted between the attachment surface 43 of connecting hosel 42 and attachment surface 28 of the putter head 12 in the manner contemplated by this invention and described below. It is preferred that the thickness of the adapter range from 0.1 cm to 0.2 cm, and most preferably, 0.15 cm, although the thickness can be greatly varied so long as it is sufficiently rigid and strong to hold the assembled shaft and putter head in proper relationship without slippage or tearing. The adapter is comprised of any solid material including plastics, wood, brass, steel, aluminum, or any other suitable metal alloy.

Adapter 50 further includes a plurality of holes divided into two groups, one group being a plurality of angle defining holes 52, the second a plurality of angle setting holes 53. The angle defining holes 52 have their centers disposed in a first arc of circle around center hole 51 at a distance R1 from the center of hole 51. The angle setting holes 53 have their centers disposed in a second arc of circle around the center of hole 51, but at a distance R2 from said center of hole 51. Distances R1 and R2 correspond to the distances of locator pins 29 and 45 from axes 14 and 41 respectively. Angle defining holes 52 are sized to accept the locator pin 29, and angle setting holes 53 are sized to accept locator pin 45.

Angle defining holes 52 are disposed along an arc of circle around the center of hole 51 at a position opposite angle setting holes 53. This is an essential feature of the device in that the placement of each angle defining hole 52 determines the shaft axis angle which is set by the opposite located angle setting holes 53.

Figure 7A:
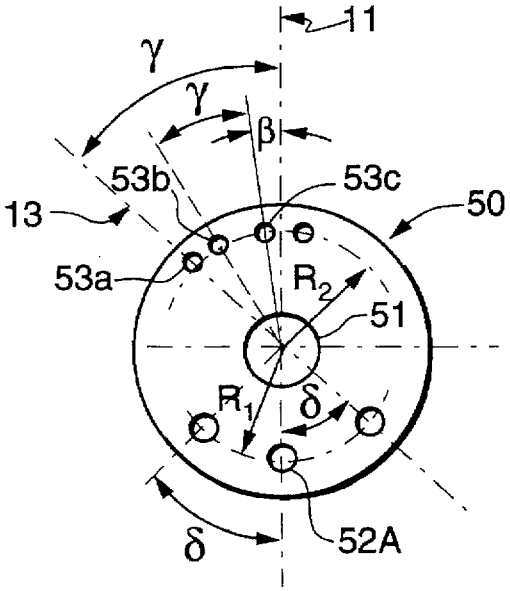
FIGS. 7(*a*) and 7(*b*) illustrate how to obtain an incremental shaft angle change which is less than the minimum distance between two adjacent setting holes.
Figure 7B:
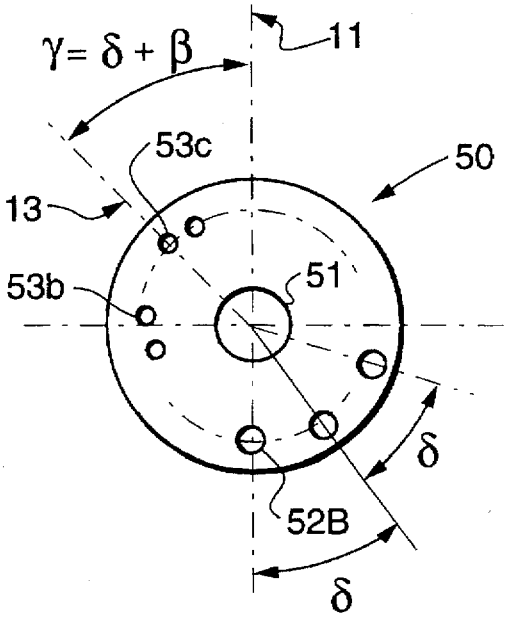

FIG. 7 illustrates the way the adapter functions to change and set the angle γ of the shaft axis 13 relative to the vertical line 11. In FIG. 7*a* the locator pin 29 on the putter attachment surface 28 is inserted in angle defining hole 52*a*. Assembling the shaft with pin 45 inserted in either of the two angle setting holes 53*a* and 53*b* defines two possible angles γ and γ' at which the axis 13 of shaft 10 can be set relative to the vertical line 11. Note that setting hole 53*c* makes a small angle β with the vertical line 11. By next setting the locator pin in angle defining hole 52*b* instead of 52*a*, the adapter is rotated by an angle a and 53*c* shifts to a new position which is at a new angle γ"=δ+β. Thus by appropriate selection of the angles δ and β one can adjust the angle of the shaft by angular increments which are smaller than the diameter which the angle setting holes would otherwise permit.

FIGS. 8*a*–8*f*, show a preferred embodiment of an adapter 50 in which there are provided three angle defining holes 52*a*–*c*, and six angle setting holes 53*a*–*f*. As shown in these figures, angle defining holes 52*a*–*c* are positioned such that the shaft axis 13 may be set at any one of 16 different angles γ, eight of them to the left of line 11 and eight more to the right, permitting a selection of a total of eight different angles each for a left handed or a right handed user.

Figure 8A:
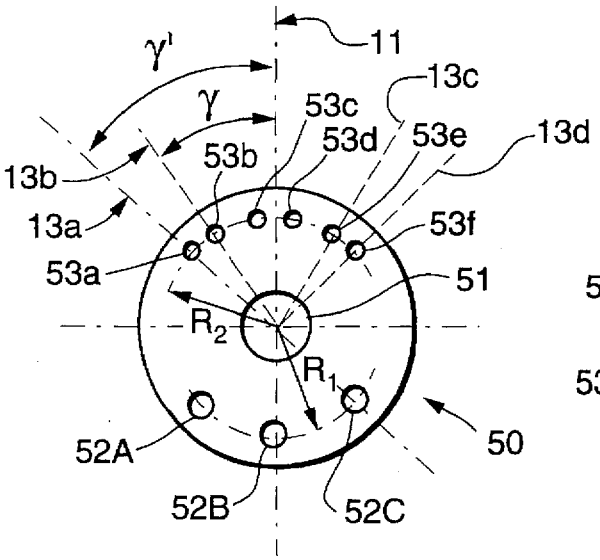
FIGS. 8(*a*)–(*f*) illustrate how an adapter is used to obtain 16 different shaft angles.

As seen in FIG. 3, the adapter 50 fits between the shaft attachment surface 43 and the putter head attachment surface 28. The pins 45 and 29 are inserted to a combination of holes 53 and 52 respectively. FIG. 8*a* shows the adapter 50 in a first position, wherein pin 29 is inserted in angle defining hole 52*b*. The shaft can now be mounted in one of four possible orientations, depending on the positioning hole selected for insertion of pin 45. Pin 45 can be inserted in hole 53*a*, 53*b*, 53*e* and 53*f*, resulting in the shaft axis extending along 13*a*, 13*b*, 13*c*, or 13*d*. Insertion in holes 53*c* and 53*d* will result in a substantially vertical orientation of the shaft which is not an angle allowed by the USGA Rules, and therefore not a useable shaft angle.

Figure 8B:
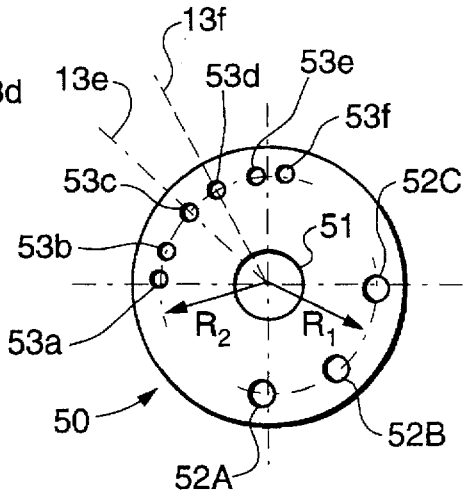
Figure 8C:
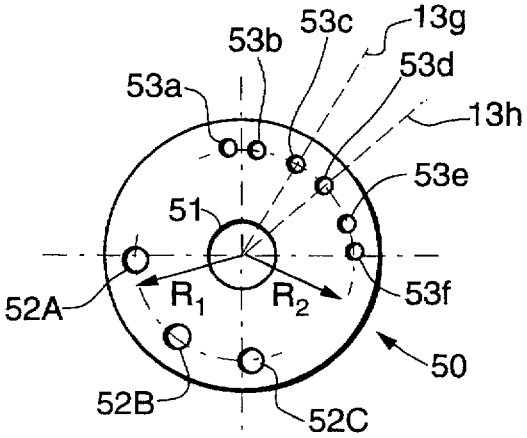

FIG. 8*b* shows the case where the angle defining hole 52*a* is placed over locator pin 29. This allows the shaft axis 13 to be oriented in any one of two new angles as shown in dotted lines in FIG. 8*b*, as set by the angle setting holes 53*c* and 53*d*. (Angle setting holes 53*a* and 53*b* results in an angle γ which is too large to be useable, and 53*e* and 53*f* are at such position that the shaft would again be almost vertical). FIG. 8*c* shows pin 29 inserted in hole 52*c* which permits placing pin 45 in any one of angle setting holes 53*c* and 53*d*, providing two more possible angles for the shaft axis 13, again shown in dotted lines. Thus a total of eight practical and/or permissible angles γ are available for the shaft axis.

Figure 8D:
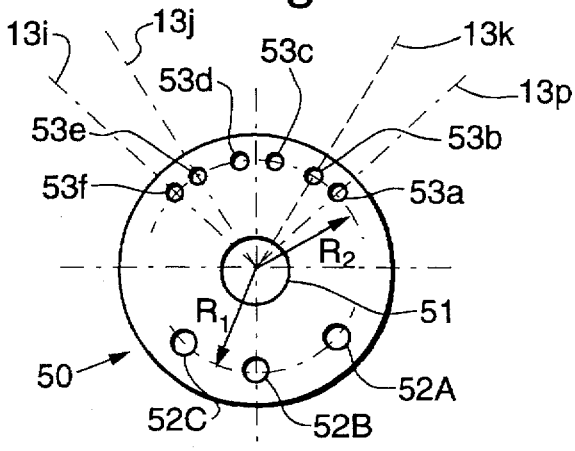
Figure 8E:
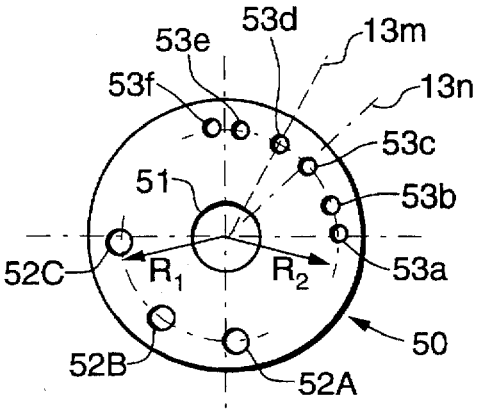
Figure 8F:
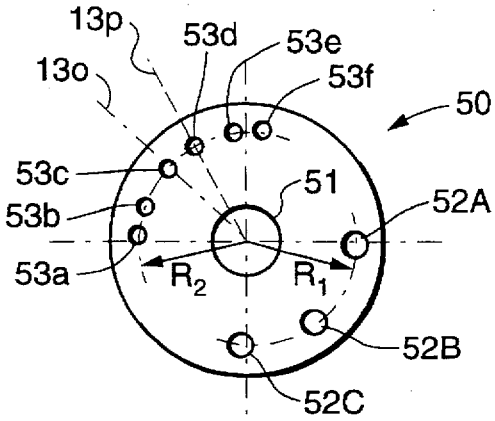

The adapter can next be flipped over to provide eight more angles for the shaft as shown in FIGS. 8*d* through 8*e*. Preferably, the distance between defining holes 52*a* and 52*b* is different from the distance between setting holes 52*b* and 52*c*.

In a practical example illustrating the advantage of the above described setup, let us assume that the minimum angular distance between two adjacent angle setting holes is 5°. For the adapter illustrated in FIGS. 8(*a*)–8(*e*), the combination of angle defining hole 52*b* with angle setting hole 53*a* may be selected to produce a shaft angle γ=25° when used by a right handed user. When used with angle setting hole 53*b* the shaft then would be at γ=20°. Next, as shown in FIG. 8*b*, switching angle defining holes to 52*a*, and using angle setting hole 53*c* may be selected such that the shaft is at γ=24°, while use of setting hole 53*d* produces an angle γ=19°. Similarly, flipping the adapter over and using the combination of defining hole 52*b* with angle setting holes 53*f* and 53*e*, as shown in FIG. 8*d* provides two more shaft angles, which may be selected as 23 ° and 18°. Finally, still using the flipped over adapter as shown in FIG. 8*e* we obtain another two shaft angles using setting holes 53*d* and 53*c* which can be 12° and 17°. Thus an incremental change in the shaft angle of less than the minimum spacing of the angle defining holes has been obtained. A similar set of practically continuous change in the angular incrementing of the shaft angle is obtained for the left handed player using the same adapter 50, as shown in FIGS. 8*a*, 8*c*, 8*d*, and 8*f*.

The adapter is preferably marked so that a user knows which combination of defining and setting holes produces what angles, and such angles are preferably marked with reference to the horizontal rather than the vertical plane. Thus for instance the combination of defining hole 52*b* with setting hole 53*a* which produces the angle γ=25° will be marked as a 65° and the angle produced when the pin 45 is set in hole 53*b* is marked as 70°. In a preferred embodiment, fewer possible angle adjustment holes than shown above may be provided to permit easy marking and assembly of the adapter. For instance, the holes which end up vertical (and are therefore illegal to use) may be omitted, and only the holes remaining on the upper left quarter and upper right quarter of the adapter part may be made available to the user, each marked appropriately. A multiplicity of adapter keys may be used to provide more adjustment angles than is practical with a single adapter.

Distances R1 and R2 are not limited to any particular distance, so long as they do not exceed the available space on attachment surface 28 of putter head 12. In the preferred embodiment, distances R1 and R2 range from 0.5 cm to 1.2 cm, and more preferably, 1 cm.

It is also preferred that locator pin 29 and corresponding angle defining holes 52 be of a different diameter than locator pin 45 and corresponding angle setting holes 53 in order to avoid the problem of reversing the angle defining holes of adapter 50 with the angle setting holes.

Figure 10:
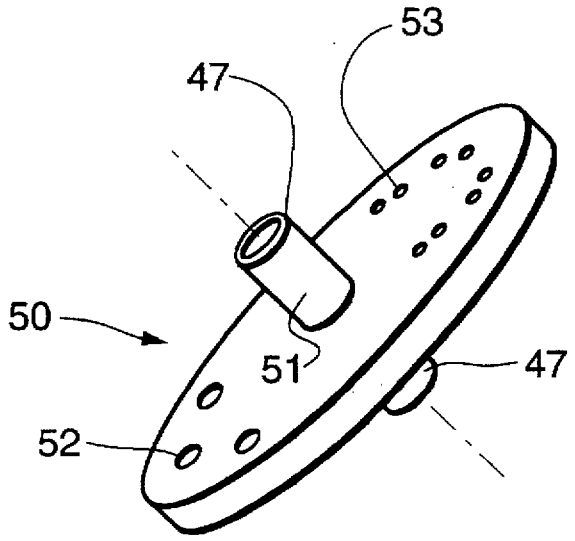
FIG. 10 is a preferred embodiment of an adapter according to the present invention.

FIG. 6 shows how the shaft and a preferred embodiment of the adapter (shown in FIG. 10) are attached to the putter head. The adapter 50 of this embodiment includes a hollow cylindrical hub 47 extending through the center hole 51 on either side of the adapter. Hub 47 facilitates the assembly by holding the shaft, the putter head and the adapter in place and permitting the easy insertion of a fastener 38 to firmly secure the three pieces together. Fastener 38 is used to attach the shaft 10 to the head 12 and to help keep the shaft and head from loosening. The hub 47 and the fastener 38 extends coaxial with the hosel axis 41 and the strike axis 14 through fastener hole 44 of hosel 42, center hole 51 of adapter 50 and into threaded socket 37 of putter head 12. Fastener 38 may be a shoulder screw, as shown, although other screws or fastening devices are contemplated and will work in the invention. A plain round head socket screw is adequate and preferred for most instances. The putter head 12 may also include a provision for a means to secure fastener 38 after it has been threaded into threaded socket 37. This is accomplished by providing a second screw socket 39 on the sole 21 of head 12 which intersects threaded socket 37. A second fastener 49 is inserted into socket 39 and is driven against fastener 38. It is preferred that second fastener 49 is a set screw which can be driven into shoulder screw 38 to hold it in place. A cap 62 is used to cover the access to set screw 49 and a cap 61 closes the access to shoulder screw 38. Again such arrangement is optional and a simple lock-nut washer may be used to prevent the accidental loosening of fastener 38.

A USGA regulation which must be accounted for requires that the connection between the shaft and the putter head be such that the shaft angle may not be altered during a tournament game. Therefore for the putter of the present invention to be acceptable for use under the USGA regulations, the connection must be such that the putter head and shaft, once assembled cannot be frictionaly rotatable relative to each other by twisting the two.

The length of fastener 38 is selected such that when the adapter is not used, the fastener bottoms out in threaded socket 37 without pressing the hosel against the putter head. When the adapter is present the fastener 38 does not bottom out in threaded socket 37 thus permitting a tight attachment of the hosel to the putter head. The presence of the two locator pins 45 and 29 together with the center fastener 38 extending through both the hosel hole 44, adapter hole 51 and putter screw socket 37 provide a three point attachment which prevents any changes in the setting of the shaft to putter angle without disassembling of the putter.

In the absence of the adapter, a tight assembly of the hosel and putter head, using the same fastener without the adapter present, may still be possible because the pins offset the hosel by substantially the same amount as the fastener, and the fastener 38 does not bottom out. Thus, the hosel can be force-fitted to the putter head without the adapter. In the absence of the adapter, the angle of the shaft to the putter could be altered by twisting the putter head relative to the shaft.

To comply with USGA Rules, there is need for a design which will not allow one to force fit the hosel 42 to the putter head 12 without the adapter 50 present.

Such is a preferred embodiment, shown in FIG. 3, and also in FIGS. 4 and 5, wherein attachment surface 28 further comprises an anti force-fit groove 80 formed in an arc of circle along the upper portion of attachment surface 28, and a second anti force-fit groove 81 in the back surface 28 of the putter head. The location is such that pin 45 fits in the groove 80 and pin 29 fits in groove 81 when the shaft and putter are assembled. The grooves are deep enough so that the pins 45 and 29 do not reach the bottom of the groove even if the adapter is omitted in the assembly. Thus, with the pins nesting in the grooves, the fastener 38 now bottoms out and prevents tightening of the hosel against the rear surface of the putter. The hosel therefore cannot be force-fitted to the putter, but the assembly remains loose and unusable.

Figure 9:
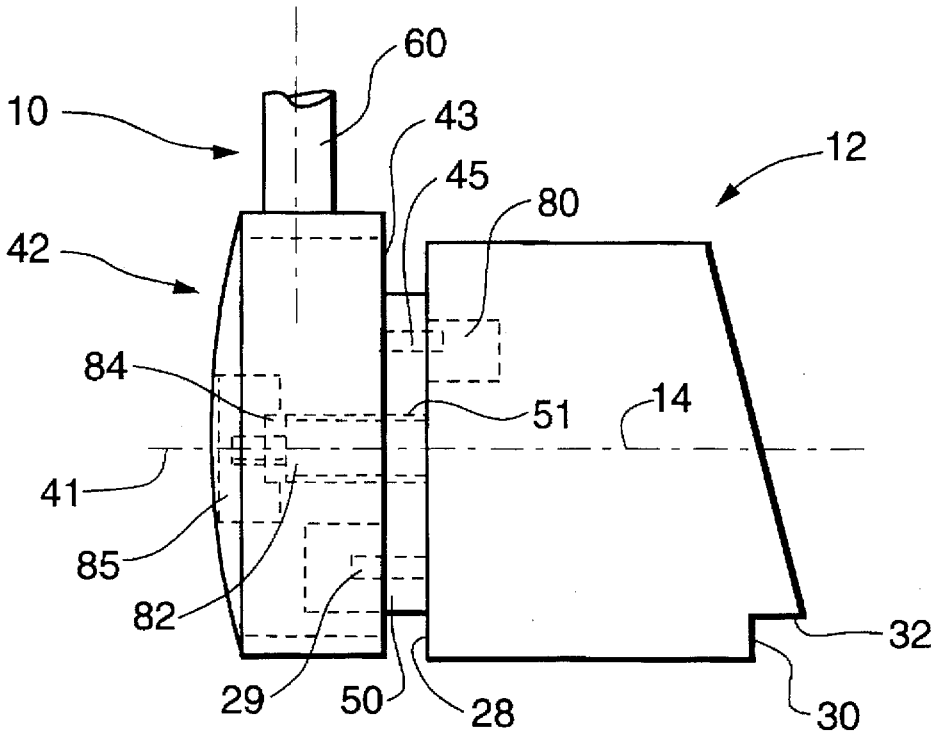
FIG. 9 is an elevation view of the manner of attachment of the shaft to the putter head in an alternate embodiment of the invention.

The fastener 38 may be provided as an integral part of the putter head, extending from the second attachment surface towards the hosel, as shown in FIG. 9. A cut-out 85 is provided in the hosel 42. A nut 84 which fits in the cut-out is used to secure the hosel to the fastener 38. In this embodiment, a shoulder 82 is provided in the fastener 38 which extends to a length less than the distance "L" measured from the surface 43 of the hosel to the bottom end 86 of the cut-out 85 in the hosel, plus the adapter thickness, but longer than distance "L" alone, thus preventing the secure attachment of the hosel to the putter head in the absence of the adapter.

An alternate embodiment is contemplated which avoids the use of an adapter 50. In this embodiment, one set of positioning holes is located on the attachment surface 43 of the hosel 42 while the other set of positioning holes is located on attachment surface 28 of the putter head 12. In this embodiment, the locator pin 45 of the hosel 42 is adapted to fit directly into the positioning holes formed in the attachment surface 28 of putter head 12. Conversely, locator pin 29 of attachment surface 28 of the putter head 12 is adapted to fit directly into the positioning holes formed in the attachment surface 43 of hosel 42. As such, there is no need for an adapter. This embodiment, however, has only a limited number of possible angular adjustments for the shaft.

Those skilled in the art having the benefit of the teachings of the present invention as hereinabove set forth, can effect numerous modifications thereto. These modifications are to be construed as being encompassed within the scope of the present invention as set forth in the appended claims.

We claim:

1. A golf putter comprising:

an elongated shaft having a first attachment surface;

a putter head having a second attachment surface;

an adapter having a first plurality of angle defining holes along a first arc of circle and a second plurality of angle setting holes along a second arc of circle;

a first locator pin on one of said first and second attachment surfaces for engaging one of said first plurality of angle defining holes and a second locator pin on the other one of said attachment surfaces for engaging said second plurality of angle setting holes; and a fastener attaching said elongated shaft and said adapter to the putter head.

2. A golf putter according to claim 1 wherein the first arc of circle has a radius R1 and the second arc of circle has a radius R2 and R1<R2.

3. A golf putter according to claim 1 wherein the first arc of circle has a radius R1 and the second arc of circle has a radius R2 and R1=R2.

4. A golf putter according to claim 1 wherein the first arc of circle and the second arc of circle have the same center.

5. A golf putter according to claim 4 wherein the first and second arcs of circle are on opposite sides of the center.

6. A golf putter according to claim 1 wherein the fastener for attaching said elongated shaft to the putter head extends through said second connecting surface and said first connecting surface.

7. A golf putter according to claim 1 wherein the adapter includes a center hole and a hub extending therethrough.

8. A golf putter according to claim 1 wherein the fastener for attaching said elongated shaft to the putter head extends through said second connecting surface and is integral with said first connecting surface.

9. A golf putter according to claim 1 wherein the putter head includes a cutout portion.

10. A golf putter comprising:

a putter head having with reference to a front vertical planar reference surface and a bottom horizontal planar reference surface: a top, a sole, a toe, a heel, an attachment surface, a strike axis and a striking face;

an elongated shaft having a first end and a second end;

a hosel removably attached to one end of the shaft, said hosel having an attachment surface adapted to attach to the attachment surface of the putter head, said hosel comprising a fastener hole and a first locator pin, said first locator pin disposed a distance R1 from said fastener;

at least one adapter, cooperable with the connecting surface of the hosel and the attachment surface of the putter head, to position the elongated shaft at a predetermined desired fixed angle g relative to the head, said adapter having a center hole adapted to align with the fastener hole of the hosel, a first plurality of positioning holes disposed along a first arc of circle around said center hole at a distance R2 from said center hole, and a second plurality of positioning holes disposed along a second arc of circle around said center hole at a distance R2 from said center hole;

a fastener removably attaching said hosel and said adapter to the attachment surface of the putter head.

11. The putter according to claim 10 wherein the adapter is reversible.

12. The putter according to claim 10 wherein the putter head includes an angular cutout located at the intersection of the strike face and the sole, and wherein the cutout has a first, vertical planar side located a distance D2 from the intersection of the horizontal side and the strike face and a second, horizontal planar side located a distance D1 from a lowermost point of the sole.

13. The putter according to claim 12, wherein D1=D2.

14. The putter according to claim 13, wherein D1=D2=3/16 inches.

15. A golf putter comprising:

a putter head having, with reference to a from vertical planar reference surface and a bottom horizontal planar reference surface: a top, a sole, a toe, an attachment surface, a strike axis, a striking face, a centered socket on said attachment surface, a first locator pin disposed a distance R1 from the central socket and a first plurality of positioning holes disposed along a first arc of circle around the central socket at a distance R2 from the socket;

an elongated shaft having a first end and a second end;

a hosel removably attached to one end of the shaft, said hosel having an attachment surface adapted to attach to the attachment surface of the putter head, said hosel comprising a fastener hole, a second locator pin disposed a distance R2 from the fastener hole, and a second plurality of positioning holes disposed along a second are of circle around the fastener hole at a distance R1 from the fastener hole; and a fastener removably attaching the hosel to the attachment surface of the putter head.

* * * * *

UNITED STATES PATENT AND TRADEMARK OFFICE

CERTIFICATE OF CORRECTION

PATENT NO. : 5,716,287

DATED : February 10, 1998

INVENTOR(S) : Reynold J. Levocz

Joseph W. Szewc

It is certified that error appears in the above-identified patent and that said Letters Patent is hereby corrected as shown below:

In claim 10, on column 8, line 67, replace "R2" with: --R1--.

In claim 15, on column 9, line 19, replace " from " with: --front--.

Signed and Sealed this

Twenty-first Day of April, 1998

*Attest:*

BRUCE LEHMAN

*Attesting Officer*

*Commissioner of Patents and Trademarks*